US007127905B2

(12) United States Patent
Eisenhower et al.

(10) Patent No.: US 7,127,905 B2
(45) Date of Patent: Oct. 31, 2006

(54) VAPOR COMPRESSION SYSTEM STARTUP METHOD

(75) Inventors: Bryan A. Eisenhower, East Hartford, CT (US); Julio Concha, Rocky Hill, CT (US)

(73) Assignee: Carrier Corporation, Farmington, CT (US)

( * ) Notice: Subject to any disclaimer, the term of this patent is extended or adjusted under 35 U.S.C. 154(b) by 31 days.

(21) Appl. No.: 10/742,049

(22) Filed: Dec. 19, 2003

(65) Prior Publication Data

US 2005/0132732 A1 Jun. 23, 2005

(51) Int. Cl.
*F25B 39/04* (2006.01)
*F25B 27/00* (2006.01)

(52) U.S. Cl. ..... 62/183; 62/238.6; 236/20 R

(58) Field of Classification Search ..... 62/183, 62/238.6, 238.7, 127, 180; 236/20 R, 25 R, 236/26 R, 26 F; 237/2 B
See application file for complete search history.

(56) References Cited

U.S. PATENT DOCUMENTS 5,245,836 A 9/1993 Lorentzen et al.
6,418,735 B1 7/2002 Sienel
6,418,737 B1 7/2002 Kuroki et al.
6,430,949 B1 * 8/2002 Noro et al. ..... 62/183
6,467,288 B1 * 10/2002 Kuroki et al. ..... 62/197
6,467,289 B1 * 10/2002 Kuroki et al. ..... 62/201
6,505,476 B1 1/2003 Nishida et al.
2003/0061827 A1 * 4/2003 Sakakibara ..... 62/224

FOREIGN PATENT DOCUMENTS

EP 0 092 864 A2 11/1983
JP 58129147 8/1983
JP 2002250560 9/2002
JP 2002318016 A * 10/2002
JP 2002340401 11/2002
JP 2002340440 11/2002

* cited by examiner

*Primary Examiner*—Chen Wen Jiang
(74) *Attorney, Agent, or Firm*—Carlson, Gaskey & Olds

(57) ABSTRACT

A method of controlling a startup operation in a heat pump water heater system prevents inadvertent shutdowns and/or low operating efficiencies via closed loop control of the system. The method includes choosing an expansion valve opening at startup near an expected steady state value to ensure high system capacity as early as possible, setting a water pump signal to a high level to maximize cycle efficiency during warm-up, and applying closed loop control over the expansion valve and the water pump to increase the pressure in the system in a controlled manner until the system reaches a steady operating state. The method provides stable startup control even if a transcritical vapor compression system is used as the heat pump.

11 Claims, 3 Drawing Sheets

VAPOR COMPRESSION SYSTEM STARTUP METHOD

TECHNICAL FIELD

The present invention relates to vapor compression systems, and more particularly to a method of controlling a warm-up procedure for a vapor compression system.

BACKGROUND OF THE INVENTION

Vapor compression systems are often used in heat pumps to, for example, heat and cool air, water, or other fluids. Most simple compression systems operate at a subcritical state where the refrigerant in the vapor compression system is maintained at a combined liquid-vapor state. To provide an additional degree of freedom over compression system control, however, a user may choose to use a transcritical compression system, which allows the refrigerant to reach a super-critical vapor state.

If a transcritical vapor compression system is used as a heat pump in a heat pump water heater, the water heater should undergo a warm-up procedure at startup to bring the heat pump to a steady state at which the components in the heat pump are at their target states. Variable overshoots may occurs in the heater during the warm-up procedure, causing the heater to shut down in an attempt to protect the heater. Further, signals from the expansion valve and the water pump may be sequenced in a manner that undesirably reduces the operating efficiency of the heater. Heat pumps incorporating transcritical vapor compression systems may be particularly vulnerable to shutdowns caused by improper startup due to their extra degree of freedom.

There is a desire for a method that brings the heat pump in the water heater to a steady state without causing variable overshoots or improper system sequencing that reduce energy efficiency.

SUMMARY OF THE INVENTION

The present invention is directed to a method of controlling a startup operation in a heat pump water heater system to prevent inadvertent shutdowns and/or low operating efficiencies. In one embodiment, the method includes choosing an expansion valve opening at startup near an expected steady state value to ensure high system capacity as early as possible, setting a water pump signal to a high level to maximize cycle efficiency, and applying closed loop control over the expansion valve and the water pump to gradually increase the pressure in the system in a controlled manner by comparing the actual pressure with a desired pressure. Once the water heater components reach steady state operation, closed loop control can be continued, if desired, to maintain the steady state.

By providing closed loop control over the system components during startup, the invention ensures that the system components reach their steady state levels without variable overshoots or efficiency losses. This is true even if the system uses a transcritical vapor compression system as the heat pump, which provides an additional degree of freedom that would ordinarily cause system instability.

DETAILED DESCRIPTION OF THE EMBODIMENTS

Figure 1:
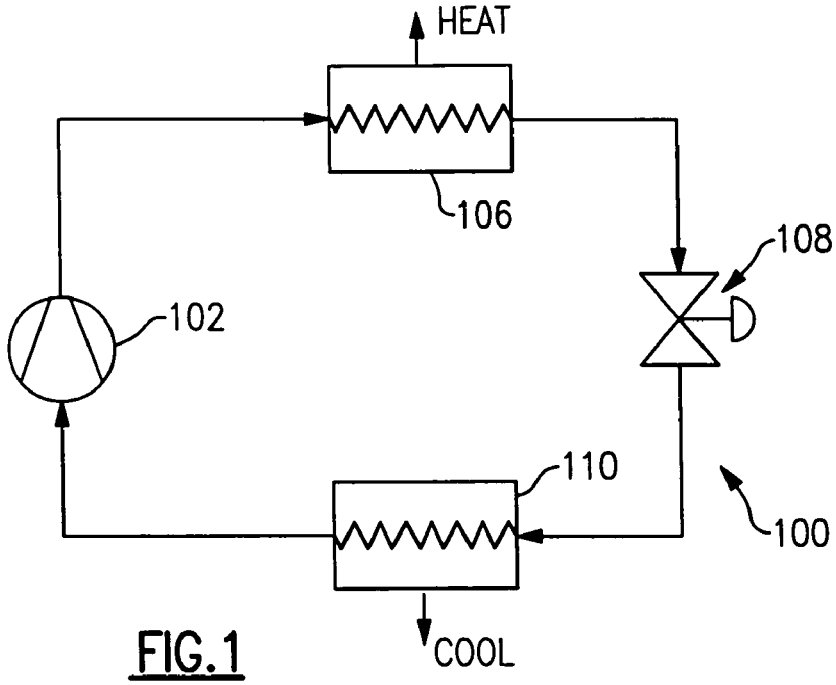
FIG. 1 is a representative diagram of a vapor compression system employing an embodiment of the invention.

FIG. 1 is an illustrative diagram of a generic vapor compression system that may employ the inventive method. Vapor compression systems are often used in heat pumps to, for example, heat and cool air, water, or other fluids. As shown in FIG. 1, a compression system 100 includes a compressor 102 that applies high pressure to a refrigerant in a vapor state inside a conduit 104, thereby heating the vapor. The vapor then travels through a first heat exchanger 106 where the heat in the vapor is released to heat a fluid, such as air or water. As the heat from the compressed vapor is absorbed by the fluid, the vapor cools. The cooled vapor is sent to an expansion valve 108 that can adjust the amount of expansion that the vapor undergoes. The vapor cools significantly as it expands, allowing the vapor to be used to cool another fluid when it is sent through a second heat exchanger 110. The cycle continues as the vapor is circulated back to the compressor 102. Thus, the compression system 100 can heat fluid flowing by the first heat exchanger 106 and cool fluid flowing by the second heat exchanger 110.

Figure 2:
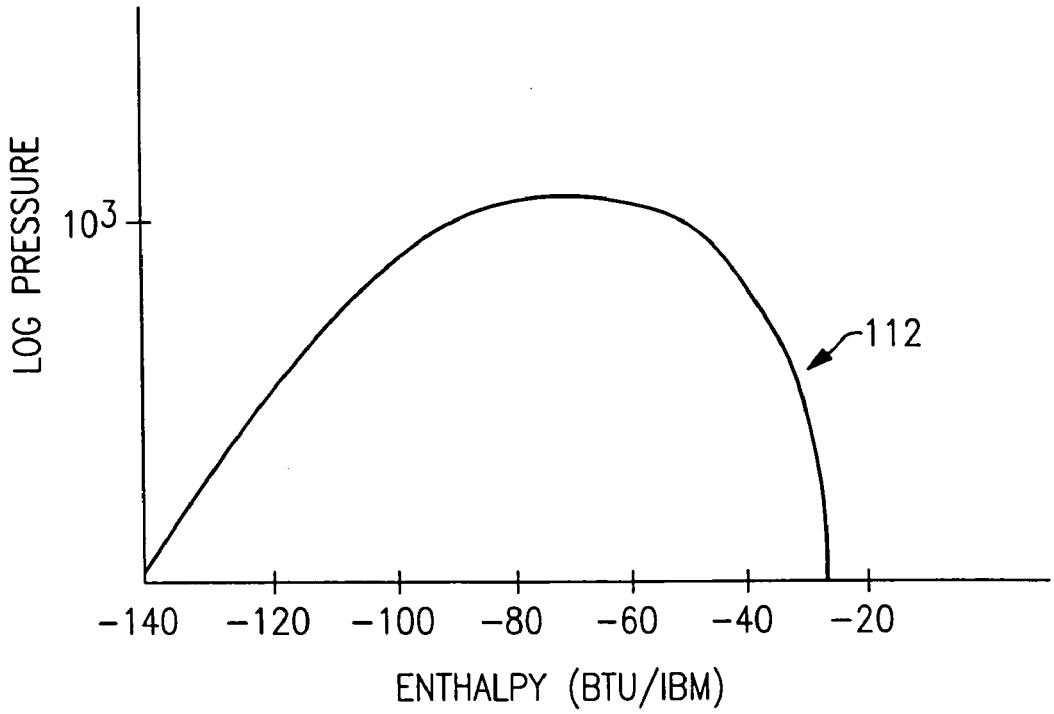
FIG. 2 is an illustrative graph of an example of a relationship between system pressure and enthalpy.

FIG. 2 is a plot showing one example of a relationship between pressure and enthalpy for a vapor compression system for illustrative purposes only. The plot shows a liquid-vapor dome 112 defining a boundary formed by particular pressure vs. enthalpy relationships. If the compression system is operating at a level below the dome 112, as is the case with subcritical compression systems, the refrigerant in the compression system stays at a combined liquid/vapor state. For simple subcritical vapor compression systems, the entire compression cycle takes place within a pressure and enthalpy range underneath the liquid-vapor dome 112. As a result, pressure and temperature are coupled together and therefore dependent on each other.

To provide an additional degree of freedom, the compression system 100 may be designed to be a transcritical vapor compression system, which allows the pressure and enthalpy to move above the dome 112 and cause the refrigerant to reach the super-critical vapor state in the compression system 100. Decoupling the pressure in the compression system 100 from temperature provides greater operational flexibility within the compression system 100 and often allows the system to reach higher operating temperatures than subcritical systems.

Figure 3:
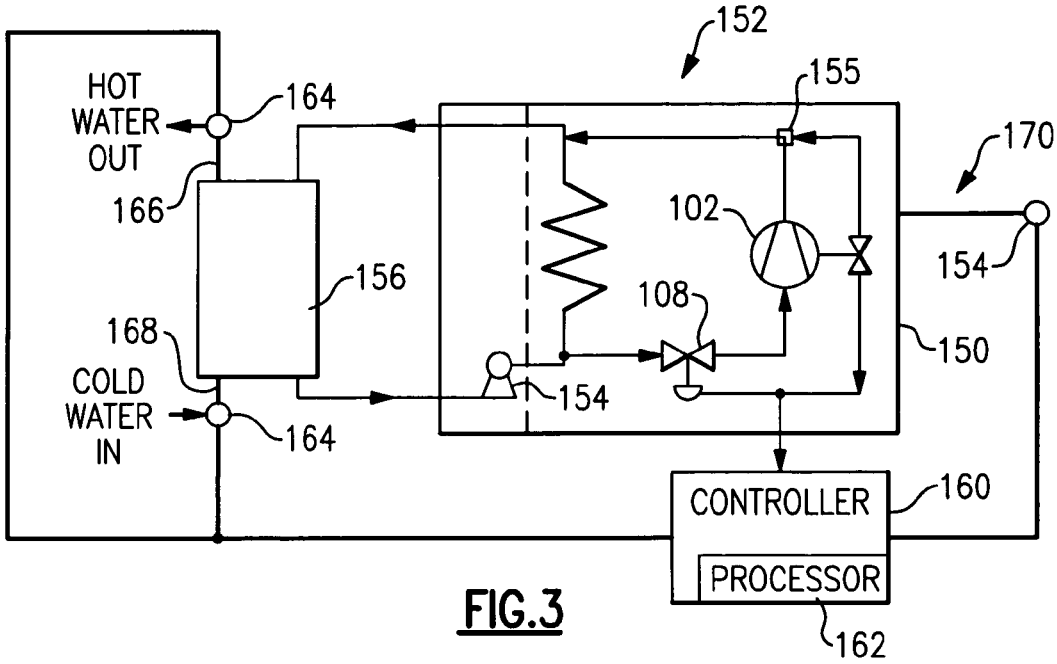
FIG. 3 is a representative diagram of a heat pump water heater to be controlled by one embodiment of the inventive method.

As noted above, the transcritical vapor compression system may be used as a heat pump 150 in a heat pump water heater 152, which is illustrated in representative form in FIG. 3. The water heater 152 has a water pump 154 that circulates water through the heater 152 and a tank 156. An evaporator fan (not shown) in the heat exchanger 106 draws heat from the air and directs it to the heat exchanger 110 so that the heat exchanger 110 can absorb heat from the air more easily. A controller 160 controls operation of the water heater 152 components and may include a processor 162 that monitors, for example, the pressure in the overall heater system via a pressure sensor 155 as well as the operating states of the compressor 102, the expansion valve 108 and the water pump 154 to provide closed loop control over the heat pump 150.

Temperature sensors 164 may be included at various points in the system, such as at the hot water outlet 166, the cold water inlet 168, and/or an outside environment 170. The temperature sensors 164 communicate with the controller 160 to provide further data for controlling system operation. For example, the temperature sensors 164 at the hot water outlet 166 and cold water inlet 168 may be used by the processor 162 in the controller 160 to determine whether to change the water volume pumped by the water pump 154, while the temperature sensor 164 in the outside environment 170 may tell the controller 160 how much energy is available in the air for the heat exchanger 106 to heat water.

To ensure that the water heater 152 quickly reaches its operating state, the water heater 152 undergoes a warm-up procedure at startup to bring the heat pump 150 to a steady state at which the expansion valve 108, the water pump 154 and the heat pump 150 are at their target states. As noted above, heat pumps incorporating transcritical vapor compression systems may be particularly vulnerable to shutdowns caused by improper startup due to their extra degree of freedom. For example, if a variable overshoot (e.g., excessive temperature and/or excessive pressure in any of the heater components) momentarily occurs during the warm-up procedure, all of the components in the heat pump 150 may undesirably shut down in an attempt to protect the overall heater system 152. Further, signals from the expansion valve 108 and the water pump 154 may be sequenced in a manner that undesirably allows the heater 152 to run at an operating vapor compression cycle with a low coefficient of performance (COP).

Figure 4:
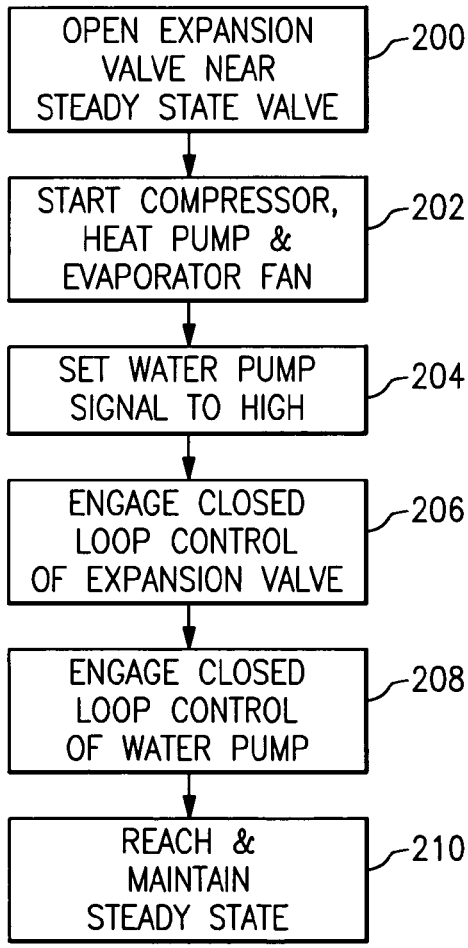
FIG. 4 is a flow diagram illustrating a method according to one embodiment of the invention.

To avoid these problems, the inventive method is directed to controlling the startup and warm-up process for a water heater employing a transcritical vapor compression system in the heat pump. FIG. 4 is a flow diagram illustrating a method according to one embodiment of the invention. Generally, the method exerts relatively tight control over the heat pump components to ensure that they quickly reach their steady operating states quickly without encountering variable overshoot or low COP values.

To do this, the controller 160 first chooses an expansion valve opening that is near an expected steady state value (block 200). The expected steady state values for given environmental conditions (e.g., ambient air temperature, water temperature, etc.), for example, may be obtained empirically and saved in a table that can be referenced by the controller 160.

Next, the controller 160 starts the compressor 102, the heat pump 150 and the evaporator fan 158 (block 202) and sets a water pump signal to a high level, thereby avoiding inefficient cycle operation of the heat pump 150 (block 204). More particularly, a high water pump signal ensures that a large amount of water is pumped through the heater system 152 early in the warm-up cycle, ensuring that the system extracts as much energy as possible from the ambient air to maximize cycle efficiency.

Figure 5:
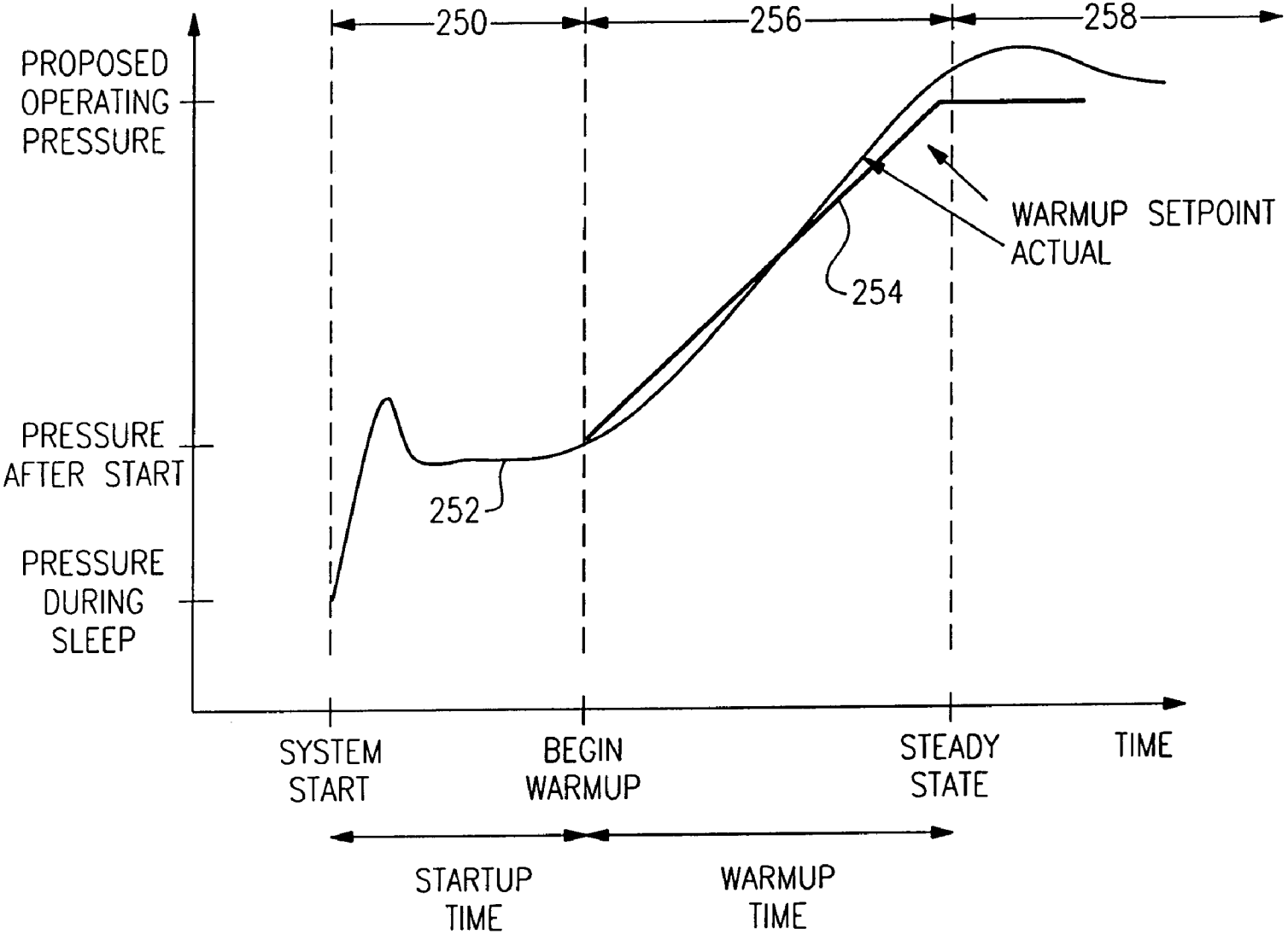
FIG. 5 is an illustrative graph of an example of a relationship between the system pressure over time during startup and warm-up of the system.

Next, the controller 160 engages closed loop control of the expansion valve 108 so that the controller 160 can modify the opening level of the expansion valve 108 based on the desired pressure and the detected pressure (block 206). FIG. 5 is a representative graph illustrating a desired warm-up operation with respect to pressure detected by the pressure sensor 155. As shown in FIG. 5, the pressure in the heat pump 150 ideally ramps up gradually after startup 250 during the warm-up time 256 to keep the pressure in the heat pump 150 stable even though the transcritical system allows an additional degree of freedom for heat pump operation. The closed loop in the system allows the controller 160 to continuously compare the pressure detected by the pressure sensor 155 with an ideal system pressure 254 at a given time and, if needed, adjust the expansion valve 108 so that the increase in the actual system pressure 252 matches the ramped increase in the ideal system pressure profile 254. This continuous monitoring and adjustment prevents the pressure in the heater system 152 from overshooting and reaching a level that would prompt system shutdown.

The controller 160 also engages closed loop control over the water pump 154, allowing the water pump 154 to controlled based on operating conditions before it reaches its steady state (block 208). The water pump 154 is controlled to maintain a given water temperature at the hot water outlet 166; for example, if the temperature sensor 164 at the hot water outlet 166 indicates that the water being delivered is too hot, the water pump 154 may pump more water through the system 100 to lower the water temperature. Similarly, if the temperature sensor 164 at the cold water inlet 168 is colder than expected, the water pump 154 may pump less water to allow more time for the water to absorb more energy as it travels through the heat pump 152.

Closed loop control over the expansion valve 108 and the water pump 154 continues until the pressure sensor 155 detects that the system reaches a desired steady state operating pressure 258 (block 210). At this point, the controller 160 may continue closed loop control over the expansion valve 108 and the water pump 154, allowing the system to continue normal steady state operation 258 even if changes in, for example, the temperature and/or pressure occur.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A method of controlling a water heater system having a heat pump with an expansion valve and a water pump, comprising:

providing a heat pump having a compressor, at least two heat exchangers, and an expansion valve, and circulating a refrigerant through said heat pump;

providing a water circuit with water driven through at least one of said two heat exchangers by a water pump to be heated by said refrigerant;

initiating startup of the water heater;

monitoring a refrigerant variable during start-up and monitoring a characteristic of the water passing through said at least one heat exchanger;

controlling said expansion valve based upon said monitored refrigerant variable, while controlling said water pump based upon said water characteristic; and setting a water pump signal to a high level after the initiating step.

2. The method of claim 1, wherein the controlling step comprises engaging closed loop control over both the expansion valve and the water pump.

3. The method as set forth in claim 2, wherein an initial position for said expansion device is selected that approximates an expected steady state position, and said closed loop control then controlling said expansion device from said initial position.

4. The method of claim 1, wherein the controlling step comprises engaging closed loop control over the expansion valve by:

comparing refrigerant system pressure with an ideal system pressure; and adjusting the expansion valve such that the refrigerant system pressure and ideal system pressure coverage.

5. The method of claim 4, wherein the ideal system pressure increases linearly over time during the startup process.

6. The method of claim 3, wherein the refrigerant system pressure allows a refrigerant in the heat pump to reach a super-critical vapor state.

7. The method of claim 1, wherein the controlling step comprises engaging closed loop control over the water pump.

8. The method of claim 6, wherein a closed loop control over the water pump is conducted also based on at least one of a hot water outlet temperature and a cold water inlet temperature.

9. The method of claim 1, further comprising measuring an ambient air temperature, wherein the controlling step is also conducted based on the ambient air temperature.

10. The method of claim 1, wherein said controlling steps also include utilizing a temperature of the water moved by said water pump in combination with said refrigerant variable for controlling said at least one of the expansion valve and the water pump.

11. A water heater system, comprising:

a heat pump having an expansion valve, a water circuit having a water pump, and a pressure sensor;

a controller operably coupled to the expansion valve, water pump and pressure sensor, wherein the controller controls at least one of the expansion valve and the water pump based on a pressure detected by the pressure sensor; and the controller sets a water pump signal to a high level at startup.

* * * * *

UNITED STATES PATENT AND TRADEMARK OFFICE

CERTIFICATE OF CORRECTION

PATENT NO. : 7,127,905 B2
APPLICATION NO. : 10/742049
DATED : October 31, 2006
INVENTOR(S) : Eisenhower et al.

It is certified that error appears in the above-identified patent and that said Letters Patent is hereby corrected as shown below:

On the Title Page:

Item (73) Assignee: Carrier Corporation, Syracuse, NY

Column 5, line 4: insert --a-- before "refrigerant"

Column 5, line 7: "coverage" should be --converge--

Column 5, line 11: "3" should be --4--

Column 5, line 17: "6" should be --7--

Signed and Sealed this

Thirtieth Day of January, 2007

JON W. DUDAS
*Director of the United States Patent and Trademark Office*